US010455873B2

(12) United States Patent
Feterman

(10) Patent No.: US 10,455,873 B2
(45) Date of Patent: Oct. 29, 2019

(54) COMBINATION GARMENT AND CARRY-ON BAG

(71) Applicant: Gerardo Feterman, Bay Harbor Islands, FL (US)

(72) Inventor: Gerardo Feterman, Bay Harbor Islands, FL (US)

( * ) Notice: Subject to any disclaimer, the term of this patent is extended or adjusted under 35 U.S.C. 154(b) by 0 days.

(21) Appl. No.: 15/367,299

(22) Filed: Dec. 2, 2016

(65) Prior Publication Data

US 2017/0231299 A1 Aug. 17, 2017

Related U.S. Application Data

(60) Provisional application No. 62/265,247, filed on Dec. 9, 2015.

(51) Int. Cl.

| | |
|---|---|
| ***A41D 15/04*** | (2006.01) |
| ***A41D 27/20*** | (2006.01) |
| ***A41D 1/04*** | (2006.01) |
| ***A45C 3/06*** | (2006.01) |
| ***A45C 9/00*** | (2006.01) |
| ***A45F 4/12*** | (2006.01) |
| ***A45C 13/10*** | (2006.01) |
| ***A45C 13/12*** | (2006.01) |

(52) U.S. Cl.

CPC ..... *A41D 15/04* (2013.01); *A41D 1/04* (2013.01); *A41D 27/202* (2013.01); *A41D 27/205* (2013.01); *A45C 3/06* (2013.01); *A45C 9/00* (2013.01); *A45C 13/10* (2013.01); *A45C 13/103* (2013.01); *A45C 13/123* (2013.01); *A45F 4/12* (2013.01); *A41D 2300/32* (2013.01); *A41D 2300/322* (2013.01)

(58) Field of Classification Search

CPC .... A41D 15/04; A41D 27/202; A41D 27/205; A41D 1/04; A45C 3/004; A45C 13/03; A45F 4/12

See application file for complete search history.

(56) References Cited

U.S. PATENT DOCUMENTS

| | | | | |
|---|---|---|---|---|
| 1,520,963 A | | 12/1924 | Nyilas | |
| 2,165,348 A | * | 7/1939 | Daiber | A41D 15/04 2/94 |
| 2,428,795 A | | 10/1947 | Frazee | |
| 2,959,789 A | | 11/1960 | Mills | |
| 2,970,316 A | | 2/1961 | Silin | |
| 4,347,629 A | | 9/1982 | Itoi | |

(Continued)

*Primary Examiner* — Adam J Waggenspack

(74) *Attorney, Agent, or Firm* — John Rizvi; The Patent Professor ®

(57) ABSTRACT

A convertible garment, such as a jacket, tunic, sweater or vest, capable of being folded and converted into a carry-on bag and adapted for carrying articles normally carried in a handbag, briefcase, carry-on bag or suitcase, with pockets on the outside and in the lining portion of the garment, arranged so that the garment is not distorted by items carried within said pockets. The garment also has a back panel accessible from inside of the garment for carrying articles such as socks, underwear, shirts and trousers, with special compartments for such clothes. Zippers and hook and loop fasteners are used as closures for some of the pockets. A method for folding the garment and converting it into a conventional carry-on bag is also disclosed.

14 Claims, 5 Drawing Sheets

(56) References Cited

U.S. PATENT DOCUMENTS 4,475,251 A * 10/1984 Hopkins ..... A45C 9/00 2/85
4,476,587 A 10/1984 Itoi
4,637,076 A * 1/1987 Tartt ..... A45F 4/12 190/107
4,655,343 A * 4/1987 Lane ..... A45C 3/004 190/111
4,700,409 A 10/1987 De Lott
4,862,520 A * 9/1989 Gazzola ..... A41D 15/04 2/69
5,075,900 A * 12/1991 Chittenden ..... A41D 13/0012 2/102
RE33,794 E * 1/1992 King ..... A45C 3/004 190/111
5,165,111 A 11/1992 Lieberman
5,278,998 A * 1/1994 Book ..... A41D 13/0012 190/1
5,370,113 A * 12/1994 Parsons ..... A41D 15/04 128/202.13
5,501,324 A * 3/1996 Franklin ..... A45C 3/004 190/109
5,566,797 A * 10/1996 Van Himbeeck ..... A45C 3/004 190/102
5,724,672 A * 3/1998 Chen ..... A41D 15/04 2/105
5,860,164 A 1/1999 Johnson
6,405,377 B1 * 6/2002 Davis ..... A41D 15/04 2/108
7,861,857 B2 * 1/2011 Vorderkunz ..... A45C 13/03 190/115
8,201,684 B2 * 6/2012 Torrellas ..... A47G 25/54 206/279
8,820,596 B1 * 9/2014 Bergquist ..... A45F 4/02 224/153
2002/0139627 A1 * 10/2002 Mahanavanont ..... A45C 3/004 190/115
2008/0134408 A1 6/2008 Kantor
2009/0034882 A1 * 2/2009 Chih ..... A41D 13/0012 383/2
2013/0081195 A1 4/2013 Faridoon
2013/0212770 A1 * 8/2013 Lettieri ..... A41D 15/04 2/84
2016/0157535 A1 6/2016 Tirro et al.

* cited by examiner

COMBINATION GARMENT AND CARRY-ON BAG

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

This invention relates to the fields of garments and bags. More specifically, it relates to a type of carry-on bag or shoulder bag, transformable into a non-bag device, with separate closure elements and means to facilitate opening closure, with means to securely maintain elements in closed configuration, formed by folding bag walls on common fold line and joining them together, intended to be used also for something other than holding contents and capable of being worn as an outer garment.

The utility and practicality of garments that are convertible into carrying bags, purses, totes, shoulder bags or the like have been well appreciated in the prior art. Examples of such convertible garments are disclosed in the following U.S. Patent Documents:

| | | |
|---|---|---|
| 1,520,963 | December 1924 | Nyilas |
| 2,428,795 | October 1947 | Frazee |
| 2,959,789 | November 1960 | Mills et al. |
| 2,970,316 | February 1961 | J. Silin |
| 4,347,629 | September 1982 | Itoi |
| 4,475,251 | October 1984 | Hopkins |
| 4,476,587 | October 1984 | Itoi |
| 4,637,076 | January 1987 | Evangeline Tartt & Sandra Weber |
| 4,700,409 | October 1987 | De Lott |
| 5,075,900 | December 1991 | Chittenden |
| 5,165,111 | November 1992 | Lieberman |
| 5,278,998 | January 1994 | Book |
| 5,860,164 | January 1999 | Johnson |
| 6,405,377 | June 2002 | Davis |
| 20080134408 | June 2008 | Kantor |
| 20130081195 | April 2013 | Faridoon |
| 20160157535 | June 2016 | Tirro; Grace; et al. |

However, none of the foregoing patents disclose a combination garment and carry-on bag as set forth herein, which is provided with a compartment for carrying clothes, which can be used even if the garment is wear, and that at the same time can be folded in such an easily and quickly way that the garment can be used as a carry-on bag and back again, rapidly, without losing any of its functions, and without detaching or adding any part of the garment. Some of the prior art bags or pouches functioned as tote bags while in the folded state, but the disadvantage of these is that when converted back to an outerwear garment there is no convenient storage area for items that were placed in the tote bag. Some of the bags are comprised of a portion of the outerwear garment.

BRIEF SUMMARY OF THE INVENTION

It is therefore an object of the present invention to provide an attractive garment especially adapted to provide a dual purpose, namely, that functions both as a garment and as a carry-on bag when desired, maintaining its aesthetic qualities at all times, and manufactured out of a variety of natural and synthetic fabric or other kinds of materials, such as leather. This garment provides sufficient space for the storage of personal articles of the user such as trousers, shirts, socks, underwear, and the articles that a person usually carries in a carry-on bag or shoulder bag. Other objects of the invention will become apparent from time to time.

Accordingly, it is an object of the present invention to provide a new and improved combination garment and carry-on bag that is worn by a person as an article of clothing and adapted for carrying a wide variety of clothes and articles normally carried in a separate handbag, suitcase, tote or carry-on bag.

Another object of this invention is to provide an attractive means for carrying clothes and articles while wearing the garment without the overall appearance of the garment being distorted by the presence of the articles.

Another object of this invention is that when the garment is folded the articles that are inside the pockets won't fall or get loose inside such pockets.

Yet another object of the invention is that the garment can be used as a carry-on bag in which the clothes that are carried maintain their position inside the compartments.

The garment has fashion appeal for both men and women, children and adults, meaning that it is attractive in appearance, simple in construction and manageability, easily manufactured, and rugged and durable in use.

Further objects and advantages of this invention will become apparent from consideration of the drawings and ensuing description thereof, and there is still a largely unmet need for a convertible garment/carry-on bag that fulfills the criteria set forth above, and that can be manufactured at a relatively low cost.

DETAILED DESCRIPTION OF THE INVENTION

Figure 1:
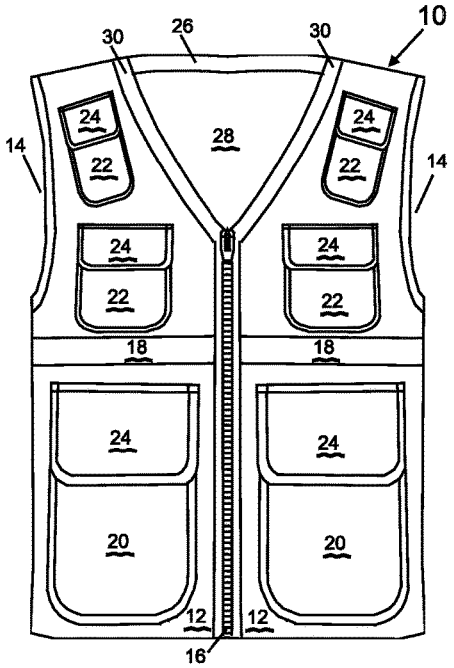
FIG. 1 is a front elevational view of the external surface of the convertible garment/bag in its garment configuration.

Referring now more particularly to the drawings, therein is illustrated an embodiment of a new garment/bag device (hereinafter simply referred to as a "garment") denoted to by the reference numeral 10, with the features of the present invention and constructed accordingly. In the present example the garment 10 is shown as a sleeveless, vest-like garment, but it is to be understood that the present invention may also take the form of other articles of clothing such as a jacket, tunic, sweater, shirt, coat, etc. In the vest configuration the garment 10 is made of flexible materials, such as fabric, leather, leatherette, etc. in an outline as shown in FIG. 1 to FIG. 10.

Referring now to the invention in more detail, in FIG. 1 and FIG. 2 the garment 10 includes a pair of opposed front panels 12, each joined or sewed along its side to the lower part of the back portion 28 just below the arm holes 14 and up to about five inches before the lower extreme of the front panels 12 as can be appreciated in FIG. 4 to FIG. 7 reference numeral 42. The two front panels 12 join together or separate, in the opposite sides of the ones joined to the back portion 28, through a fastening device 16 such as a zipper, hook-and-loop fasteners or similar. In the present example the fastening device 16 shown is a zipper.

Figure 8:
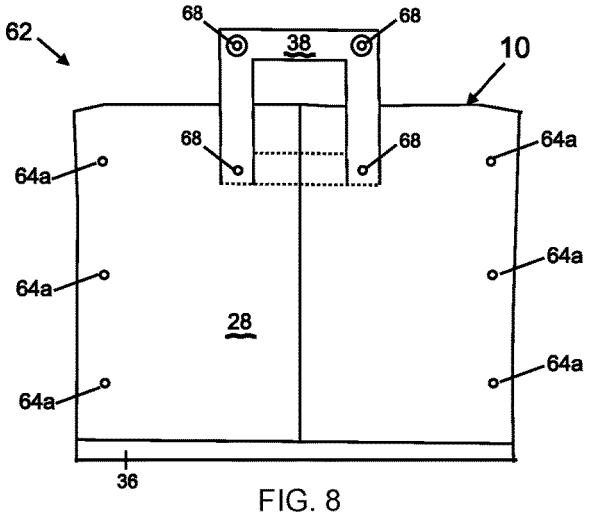
FIG. 8 is a front elevational view of the convertible garment/bag after its conversion into its bag configuration.
Figure 10:
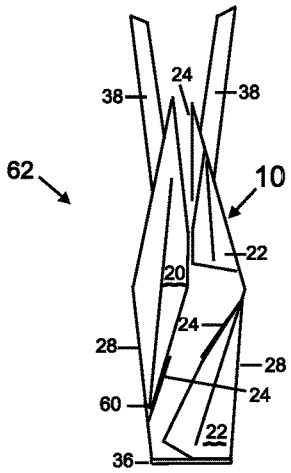
FIG. 10 is a side elevational view of the convertible garment/bag after its conversion into its bag configuration viewed without the flap 66.
Figure 9:
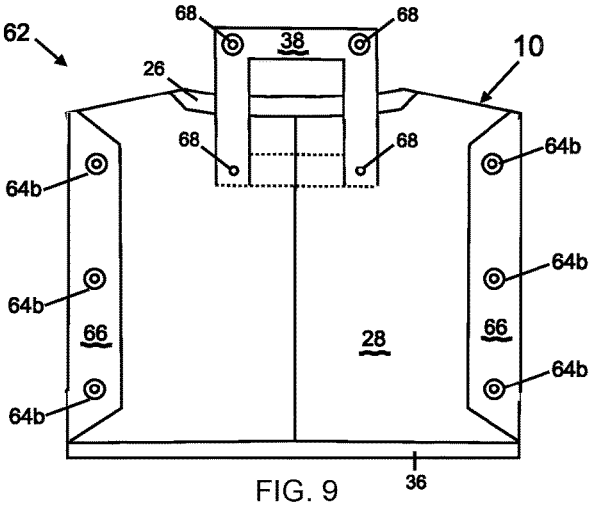
FIG. 9 is a front elevational view of the convertible garment/bag after its conversion into its bag configuration, but showing the side opposite to that shown in FIG. 8, more particularly the side on which the means for fastening one wall of the bag to the other are used.

A reinforcing strip 18 is attached to each front panel 12 right at half his height in a horizontal position, this reinforcing strip 18 is made of a flexible yet strong ribbon made of leather, leatherette, nylon, etc. The reinforcing strip 18 will be used as a base when the garment 10 converts into its bag configuration 62 as seen in FIGS. 8, 9 and 10.

Figure 11:
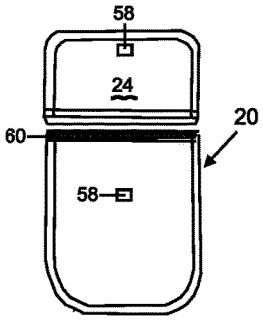
FIG. 11 is a fragmentary frontal elevational view of a flapped zippered and fastened pocket 20 with its flap raised.
Figure 12:
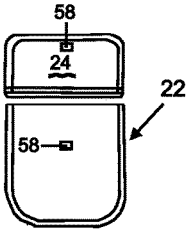
FIG. 12 is a fragmentary frontal elevational view of a flapped fastened pocket 22 with its flap raised.

The garment 10 is configured with two flapped zippered and fastened patch pockets 20, with a fastening device (e.g. hook and loop fastener) 58 and a zipper 60 under the flap 24 that serves to close the pocket 20 mouth, and a plurality of flapped fastened patch pockets 22, with a fastening device (e.g. hook and loop fastener) 58 under the flap 24 that serves to close the pocket 22 mouth. Such pockets 20 and 22 are made with a similar material to the one used in the front panels 12. FIG. 11 shows a flapped zippered and fastened pocket 20 in a view with the flap 24 raised where the fastening device (e.g. hook and loop fastener) 58 and the zipper 60 can be seen. FIG. 12 shows a flapped fastened pocket 22 with the flap 24 raised where the fastening device (e.g. hook and loop fastener) 58 can be seen. The reason for the flapped zippered and fastened pockets 20 is that when the garment 10 becomes a bag 62 the articles inside said pockets 20 wont fall down. It will be appreciated that alternative embodiments can be devised that will be configured as other types of vests or garments, such as might be preferred by different users.

The garment 10 has a reinforcement bias 26 on the upper part of the back portion 28 of the garment 10 (collar) made of a wide, soft and flexible material and sewn to the back portion 28 of the garment 10, being possible to have this bias prolonged into the front panels 12 as seen in numeral 30 of FIGS. 1, 2, 4, 5, 6 and 7. The material of this reinforcement biases 26 and 30 can be similar to the material used for the front panels 12.

Figure 2:
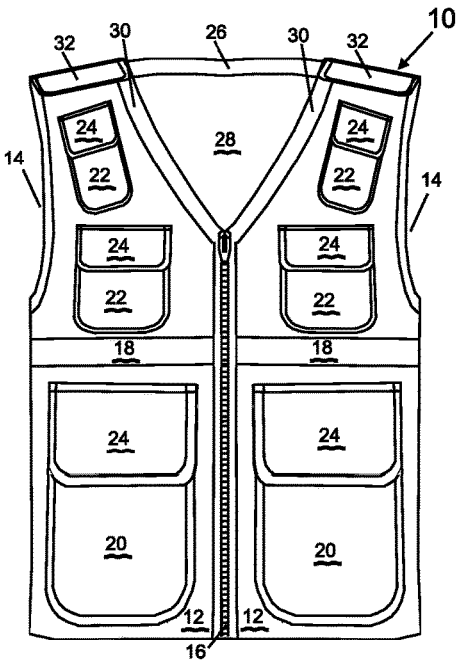
FIG. 2 is a front elevational view of the external surface of the convertible garment/bag in its garment configuration, similar to FIG. 1 but with a detachable shoulder portion.
Figure 5:
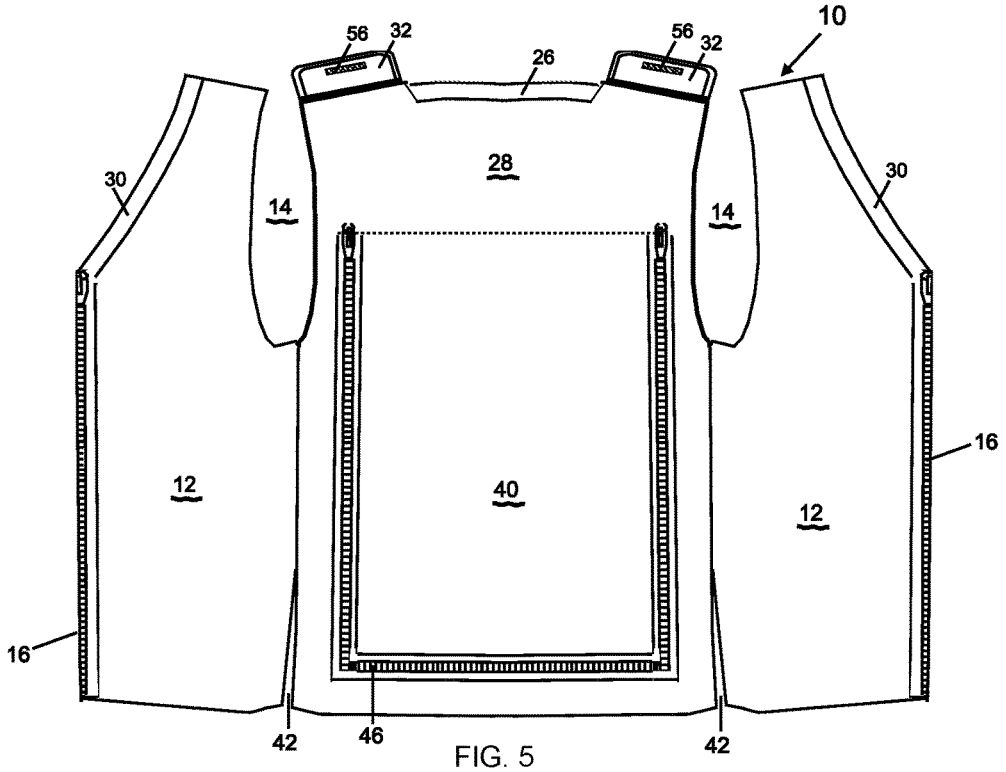
FIG. 5 is a front elevational view of the internal surface of the convertible garment/bag in its garment configuration showing the location of the concealed compartment after the shoulder portion was detached.
Figure 7:
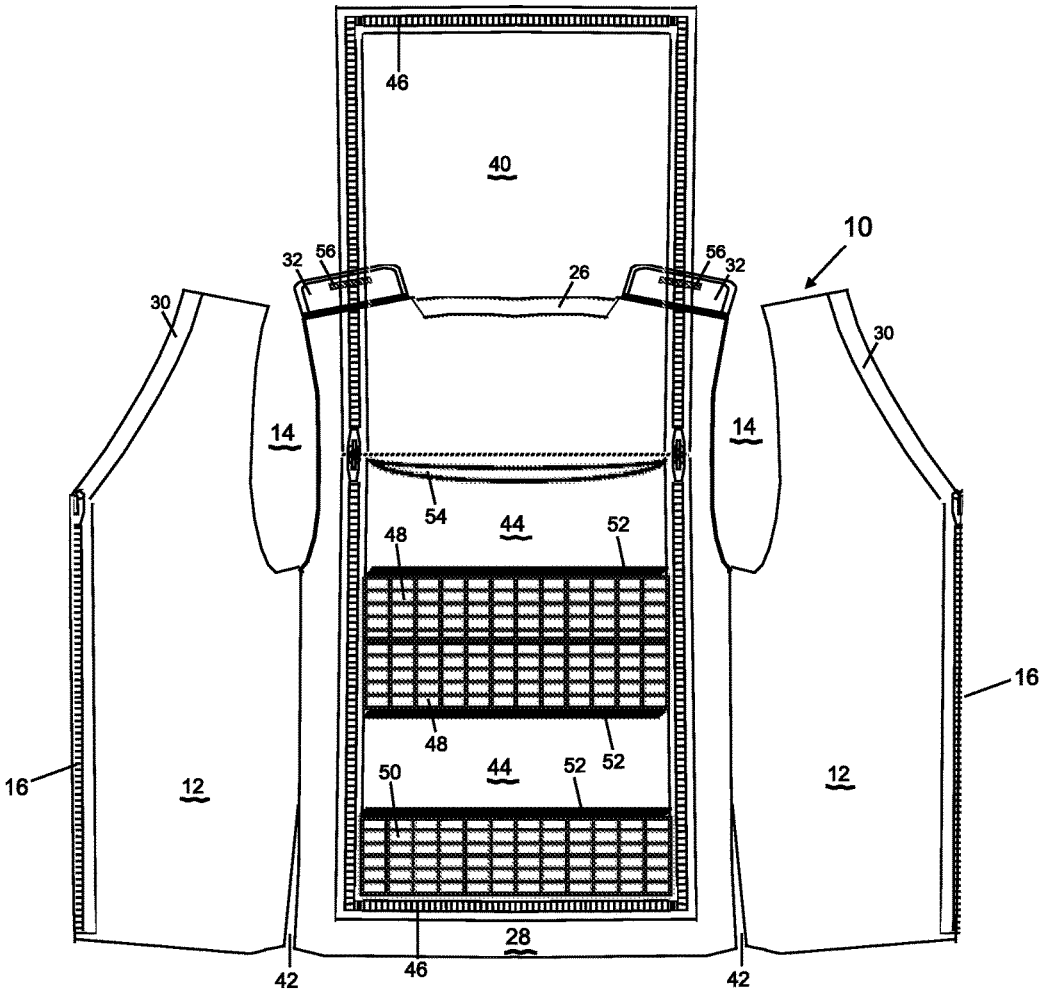
FIG. 7 is a front elevational view of the internal surface of the convertible garment/bag in its garment configuration showing the concealed compartment open and its conformation after the shoulder portion was detached.

As illustrated in FIG. 2, the garment 10 has a flap 32 in each shoulder that is fastening the back portion 28 to the upper part of the front panel 12, thus, when the flap 32 is detached from the front panel 12, the liner that is serving as cover 40 to cover the concealed compartment 44 of the garment 10 is more easily reachable. The flaps 32 have a fastening device 56 to attach into the front panels 12 as can be seen in FIGS. 5 and 7.

Figure 3:
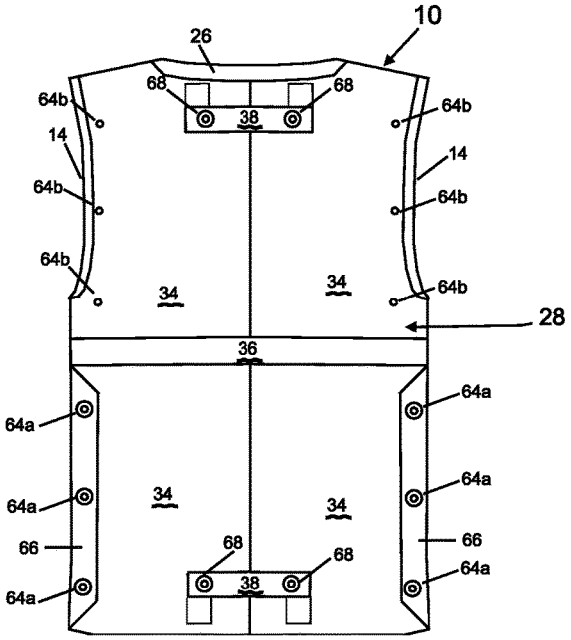
FIG. 3 is a rear elevational view of the external surface of the convertible garment/bag in its garment configuration.
Figure 4:
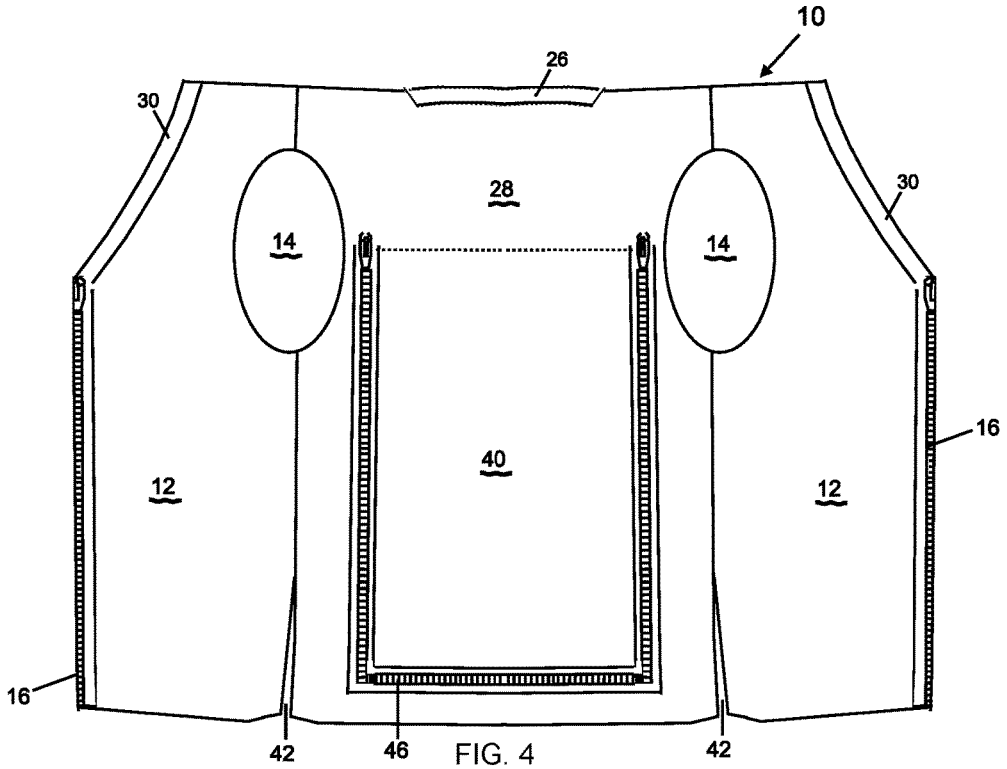
FIG. 4 is a front elevational view of the internal surface of the convertible garment/bag in its garment configuration showing the location of the concealed compartment.

As illustrated in FIG. 3, the outer back portion 28 of the garment 10 is assembled from two back panels 34 of the same or similar material as the front panels 12 sewn together along its sides down to at least five inches before the end of the garment 10 as can be seen in FIG. 4 to FIG. 7 numeral 42. A reinforcing strip 36 is attached to the outer back portion 28 of the garment 10 in a horizontal position, right at half his height, this reinforcing strip 36 can be made of the same material as the reinforcing strips 18 of the front panels 12 in FIG. 1 and FIG. 2. The reinforcing strip 36 will be used as a base when the garment 10 converts into its bag configuration 62 as seen in FIGS. 8, 9 and 10.

The outer back portion 28 of the garment 10 has two loops 38 of about fifteen inches each and preferably made from the same material as the reinforcing strips 18 and 34, sewn in both its ends (about one inch in each side) in a position parallel to the extremes and each end distant from the other about seven inches, at about two inches from the edges, of both the upper and lower parts of the outer back portion of the garment 10, and being the center of each loop 38 in exactly the center of the outer back portion of the garment 10. This loops 38 are attached to the outer back portion 28 of the garment 10 with a fastening device 68, such as a hook-and-loop fastener or a button in each side of each loop 38, in order to be hidden as decorative ornaments when not in use at its bag configuration 62. In FIG. 3 the loops 38 are fastened with a snap-on type fastener 68.

The outer back portion 28 of the garment 10 has two flaps 66 located in its lower part and sewn to the outer parts of each back panel 34 one side and the other side attached to the corresponding back panel 34 with three double sided snap buttons 64 each flap 66 or other kind of fasteners. The flaps 66 are made of the same or similar material as the front panels 12 and have about two and a half inches wide. The middle snap button **64*a* is located in the exact half of the lower outer back portion 28 of the garment 10, and the lower and upper buttons 64*a* are located at about two inches from each of the flap 66 extremes. In the upper part of the outer back portion 28 of the garment 10 are located the other part of each of the double sided snap buttons 64*b* proportionally located as to being able to attach the flaps 66 when the garment 10 is converted into its bag configuration 62, maintaining the position of each middle button 64*b* in the exact half of the upper outer back portion 28 of the garment 10**.

The interior of the garment 10 is shown in FIGS. 4, 5, 6 and 7. The garment 10 is made of a double layer of material, so that the interior surfaces of the front panels 12 define a contiguous interior surface or liner that serves as a lining to the front panels 12 and can be made of a similar or different flexible material as the front panels 12. The liner of the back portion of the garment 10 has a backing cover (the "cover") 40 that covers the concealed compartment 44, this cover 40 serves both as a liner and as protective and concealer cover for the compartment 44 as can be seen in FIGS. 4 and 5 and FIGS. 6 and 7. The cover 40 can be made of a similar or different flexible material as the front panels 12 and is attached to the liner through a fastening device 46 such as a hook-and-loop fastener or a zipper. In this example the fastening device 46 used is a zipper.

Figure 6:
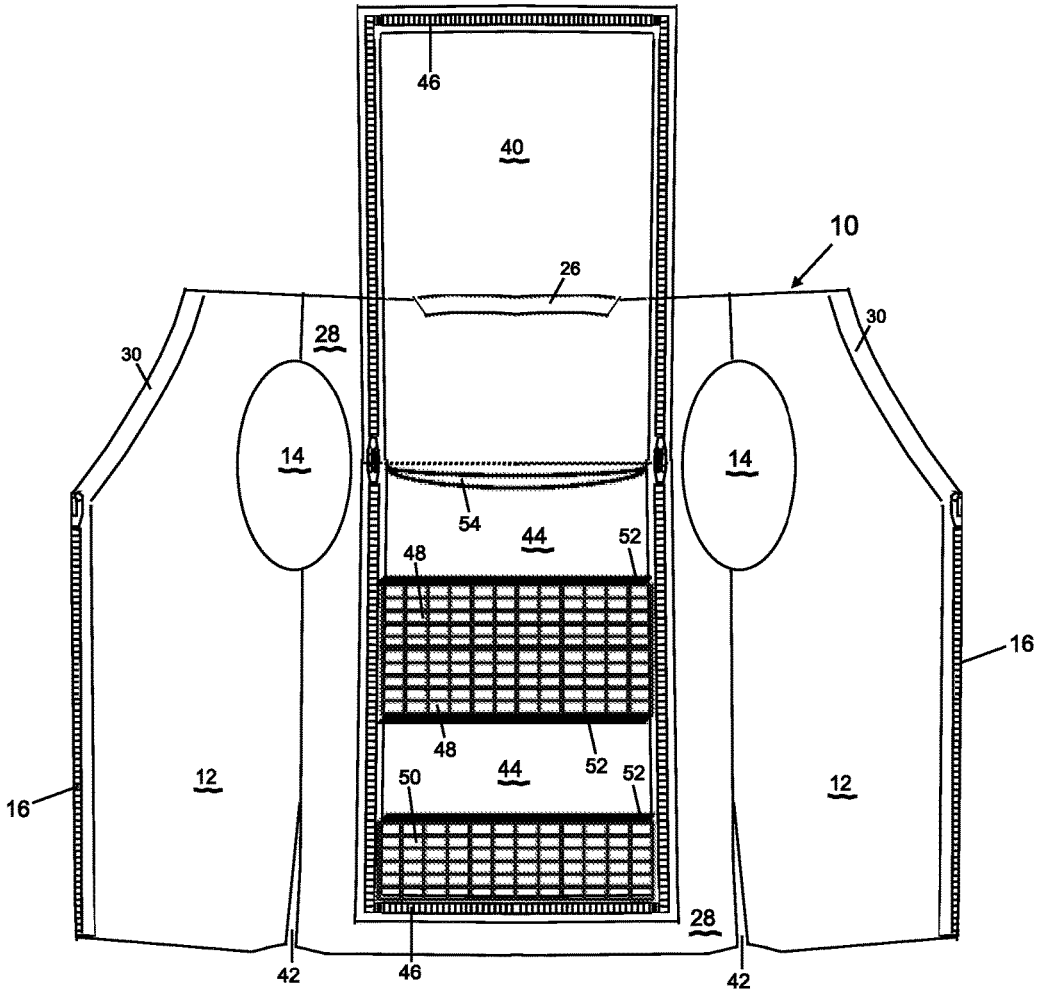
FIG. 6 is a front elevational view of the internal surface of the convertible garment/bag in its garment configuration showing the concealed compartment open and its conformation.

When the cover is opened, as seen in FIGS. 6 and 7, the concealed compartment 44 appears, this concealed compartment 44 is comprised of specially designed divisions 48 and 50 for carrying shirts, undergarment and other articles, this divisions 48 and 50 can be made from a flexible mesh and elastic 52 the present example is made as follows: the division 48 is made from a piece of mesh of about eight inches of height, sewn in its lateral sides to the back portion 28 and sewn in the horizontal direction in the exact middle of its height with a double or triple seam. The parts that are not sewn have attached a piece of elastic 52 in the whole horizontal length, without the elastic 52 being too tight as to crinkle the division 48. The intention of this elastic 52 is to be able to maintain the placed articles in its place. The lower division 50 is made from a piece of mesh of about four inches of height, sewn in its lateral sides and in its bottom to the back portion 28. The part that is not sewn has attached a piece of elastic 52 in the whole horizontal length, without the elastic 52 being too tight as to crinkle the division 50.

In the uppermost part of the concealed compartment 44 is a hanger 54 made of a rigid or semi-rigid material such as wood, plastic or plastic-covered wire. This hanger 54 serves to hang pants, skirts or similar garments. This hanger 54 is attached or sewn into the sides or top of the uppermost part of the concealed compartment 44, and has to have a space from the top of the concealed compartment 44 to the part that will be used to hang the garments. In case this hanger 54 is made from a rigid material, such hanger 54 must have a slight curvature in order not to distort the garment 10.

When the garment 10 is converted into its bag configuration 62 the flaps 66 are released from their position in the buttons 64*a*, the cover 40 is properly closed as to conceal the compartment 44 and then the garment 10 is folded following the line formed by the reinforcing strips 18 and 36, being the reinforcing strip 18 the inner part of the bag 62 and the reinforcing strip 36 the outer part. The flaps 66 are then snapped into the buttons 64*b* of its corresponding side, the loops 38 are released from its fastening devices 68 to serve as handles for the bag 62 configuration, thus converting the garment 10 into a handbag.

What I claim as my invention is:

1. A garment that is convertible between a garment configuration and bag configuration, the garment comprising:

a back portion and a front portion;

an interior layer at the back portion of the garment;

one or more integrated storage compartments being securable with compartment fasteners;

the integrated storage compartments including external compartments configured for storing items, wherein the external compartments include compartment fasteners and the external compartments are positioned to permit access to stored items in the external compartments;

wherein the garment is convertible into a bag;

wherein the garment includes at least one lower portion fastener on a lower portion of the garment, where the lower portion fastener is configured to releasably attach to an upper portion of the garment in the bag configuration such that an outer surface of the back portion of the garment becomes an outer surface of the bag configuration due to the lower portion fastener attaching the upper portion of the garment to the lower portion of the garment;

wherein the compartment fasteners are configured to keep articles stored inside the integrated storage compartments from falling out of the integrated storage compartments when the garment is in the bag configuration;

wherein converting the garment between the garment configuration and the bag configuration causes the external compartments to become internally located in the bag configuration to conceal the external compartments of the garment configuration; and wherein the garment includes handles attached on opposite ends of the garment such that when the garment is converted to the bag configuration, the handles meet for carrying the bag configuration; and wherein one of the integrated storage compartments includes a hanger compartment, the hanger compartment including a rigid or semi-rigid hanger structure positioned in an internal space of the hanger compartment for suspending garments on the hanger structure within the hanger compartment.

2. The garment of claim 1, wherein the integrated storage compartments include an interior compartment on the back portion of the garment, the interior compartment being a space located behind an inner liner of the back portion.

3. The garment of claim 1, wherein the front portion of the garment includes a pair of opposed front panels that are each joined along at least one of their sides to the back portion of the garment just below arm holes of the garment.

4. The garment of claim 1, wherein a reinforcing strip is attached to the front portion, the reinforcing strip acting as a reinforcing base when the garment converts to the bag configuration.

5. The garment of claim 1, wherein the garment includes a reinforcement on an upper part of the back portion near a collar of the garment.

6. The garment of claim 2, wherein the garment includes one or more shoulder fasteners on one or both shoulders of the garment, the shoulder fasteners configured to fasten an upper part of the back portion to an upper part of the front portion such that when a shoulder fastener of the one or more shoulder fasteners is detached from at least one of the front portion and back portion, a cover of the interior compartment is more easily reachable.

7. The garment of claim 1, wherein the garment includes a reinforcing strip attached to the back portion, the reinforcing strip acting as a reinforcing base when the garment converts to the bag configuration.

8. The garment of claim 2, wherein the interior compartment is configured to hold a hanger for hanging clothing items in the interior compartment.

9. A garment that is convertible between a garment configuration and bag configuration, the garment comprising:

a back portion and a front portion;

an interior layer at the back portion of the garment;

one or more integrated storage compartments, the one or more integrated storage compartments being securable with compartment fasteners;

the integrated storage compartments including external compartments configured for storing items, wherein the external compartments include compartment fasteners and the external compartments are positioned to permit access to stored items in the external compartments;

wherein the garment is convertible into a bag such that the bag is wearable using a strap;

wherein converting the garment between the garment configuration and the bag configuration causes the external compartments to become internally located in the bag configuration to conceal the external compartments of the garment configuration;

wherein the front portion includes a pair of opposed front panels that are each joined along at least one of their sides to the back portion of the garment;

wherein a reinforcing strip is attached to the front portion, the reinforcing strip acting as a reinforcing base when the garment converts to the bag configuration, where the garment is folded along the reinforcing strip for converting the garment into the bag configuration;

wherein the garment includes a reinforcement on an upper part of the back portion near a collar of the garment;

wherein the garment includes an interior compartment on the back portion of the garment, the interior compartment being a space located behind an inner liner of the back portion;

wherein the compartment fasteners are configured to keep articles stored inside the integrated storage compartments from falling out of the integrated storage compartments when the garment is in the bag configuration;

wherein the garment includes at least one lower portion fastener on a lower portion of the garment, where the lower portion fastener is configured to releasably attach to an upper portion of the garment in the bag configuration such that an outer surface of the back portion of the garment becomes an outer surface of the bag configuration due to the lower portion fastener attaching the upper portion of the garment to the lower portion of the garment; and wherein the garment includes handles attached on opposite ends of the garment such that when the garment is converted to the bag configuration, the handles meet for carrying the bag configuration; and wherein one of the integrated storage compartments includes a hanger compartment, the hanger compartment including a rigid or semi-rigid hanger structure positioned in an internal space of the hanger compartment for suspending garments on the hanger structure within the hanger compartment;

wherein the hanger structure is at least slightly curved to prevent the distortion of a garment suspended from the hanger structure.

10. The garment of claim 9, wherein the garment includes one or more shoulder fasteners on one or both shoulders of the garment, the shoulder fasteners configured to attach the back portion to the front portion such that when a shoulder fastener of the one or more shoulder fasteners is detached from at least one of the back portion and front portion, a cover of the interior compartment is more easily reachable.

11. The garment of claim 9, wherein the garment includes a reinforcing strip attached to the back portion, the reinforcing strip acting as a reinforcing base when the garment converts to the bag configuration.

12. The garment of claim 9, wherein the garment includes one of the lower portion fastener on each side of a lower portion of the garment, where the lower portion fasteners include a flap, where the flaps are configured to releasably attach to an upper portion of the garment in the bag configuration for laterally enclosing an internal space partially delimited by a folded front portion of the garment in the bag configuration.

13. The garment of claim 9, wherein the interior compartment is configured to hold a hanger for hanging clothing items in the interior compartment.

14. A garment that is convertible between a garment configuration and bag configuration, the garment comprising:

a back portion and a front portion;

an interior layer at the back portion of the garment;

one or more integrated storage compartments, the one or more integrated storage compartments being securable with compartment fasteners;

the integrated storage compartments including external compartments configured for storing items, wherein the external compartments include compartment fasteners and the external compartments are positioned to permit access to stored items in the external compartments;

wherein the garment is convertible into a bag such that the bag is wearable using a strap;

wherein converting the garment between the garment configuration and the bag configuration causes the external compartments to become internally located in the bag configuration to conceal the external compartments of the garment configuration;

wherein the front portion includes a pair of opposed front panels that are each joined along at least one of their sides to the back portion of the garment;

wherein a reinforcing strip is attached to the front portion, the reinforcing strip acting as a reinforcing base when the garment converts to the bag configuration, where the garment is folded along the reinforcing strip for converting the garment into the bag configuration;

wherein the garment includes a reinforcement on an upper part of the back portion near a collar of the garment;

wherein the garment includes an interior compartment on the back portion of the garment, the interior compartment being a space located behind an inner liner of the back portion;

wherein the garment includes one or more shoulder fasteners on one or both shoulders of the garment, the shoulder fasteners configured to attach the back portion to the front portion such that when a shoulder fastener of the one or more shoulder fasteners is detached from at least one of the back portion and front portion, a cover of the interior compartment is more easily reachable;

wherein the garment includes a reinforcing strip attached to the back portion, the reinforcing strip acting as a reinforcing base when the garment converts to the bag configuration;

wherein the garment includes handles attached on opposite ends of the garment such that when the garment is converted to the bag configuration, the handles meet for carrying the bag configuration;

wherein the interior compartment is configured to hold a hanger for hanging clothing items in the interior compartment;

wherein the compartment fasteners are configured to keep articles stored inside the integrated storage compartments from falling out of the integrated storage compartments when the garment is in the bag configuration;

wherein the garment includes at least one lower portion fastener on a lower portion of the garment, where the lower portion fastener is configured to releasably attach to an upper portion of the garment in the bag configuration such that an outer surface of the back portion of the garment becomes an outer surface of the bag configuration due to the lower portion fastener attaching the upper portion of the garment to the lower portion of the garment; and wherein the garment includes one of the lower portion fastener on each side of a lower portion of the garment, where the lower portion fasteners include a flap, where the flaps are configured to releasably attach to an upper portion of the garment in the bag configuration for laterally enclosing an internal space partially delimited by a folded front portion of the garment in the bag configuration; and wherein one of the integrated storage compartments includes a hanger compartment, the hanger compartment including a rigid or semi-rigid hanger structure positioned in an internal space of the hanger compartment for suspending garments on the hanger structure within the hanger compartment;

wherein the hanger structure is positioned near a top of the hanger compartment such that a space is left between the hanger structure and a top of the hanger compartment to allow the top of the hanger compartment to be sealed while a garment is suspended on the hanger structure.

* * * * *